US007003816B1

(12) United States Patent
Bowlby

(10) Patent No.: US 7,003,816 B1
(45) Date of Patent: Feb. 28, 2006

(54) FENCE SYSTEM FOR AN ABOVE-THE-GROUND SWIMMING POOL

(75) Inventor: J. Craig Bowlby, Little Rock, AR (US)

(73) Assignee: Splash Superpools LLC, North Little Rock, AK (US)

( * ) Notice: Subject to any disclaimer, the term of this patent is extended or adjusted under 35 U.S.C. 154(b) by 0 days.

(21) Appl. No.: 11/001,456

(22) Filed: Dec. 1, 2004

(51) Int. Cl.
*E04K 4/00* (2006.01)

(52) U.S. Cl. ..... 4/506; 4/488

(58) Field of Classification Search ..... 4/488, 4/504, 506, 513; 52/245
See application file for complete search history.

(56) References Cited

U.S. PATENT DOCUMENTS

| | | | | |
|---|---|---|---|---|
| 335,430 | A * | 2/1886 | Schwarz et al. | 159/23 |
| 3,076,636 | A | 2/1963 | Blum | 256/65 |
| 3,648,301 | A | 3/1972 | Wiley | 4/172.19 |
| 3,648,303 | A | 3/1972 | Stewart et al. | 4/172.19 |
| 3,815,877 | A | 6/1974 | Turner | 256/24 |
| 3,840,908 | A | 10/1974 | Greene | 4/172.19 |
| 3,877,085 | A | 4/1975 | Bukaitz et al. | 4/172.19 |
| 3,986,310 | A * | 10/1976 | van den Broek | 52/169.9 |
| 3,994,479 | A | 11/1976 | Johannesson | 256/24 |
| 4,225,120 | A | 9/1980 | McLaughlin | 256/24 |
| 4,303,226 | A | 12/1981 | Powell et al. | 256/25 |
| 4,623,126 | A | 11/1986 | Pettit | 256/25 |
| 5,161,784 | A | 11/1992 | Sader | 256/24 |
| 5,231,807 | A * | 8/1993 | Aymes | 52/65 |
| 2003/0107031 | A1 | 6/2003 | Cuzzocrea | 256/25 |

FOREIGN PATENT DOCUMENTS

| | | |
|---|---|---|
| EP | 1106751 | 6/2001 |

* cited by examiner

*Primary Examiner*—Justine R. Yu
*Assistant Examiner*—Huyen Le
(74) *Attorney, Agent, or Firm*—Gifford, Krass, Groh, Sprinkle, Anderson & Citkowski, P.C.

(57) ABSTRACT

A fence system is provided for use in conjunction with an above-the-ground flexible wall swimming pool having a liner with an upper rim defining a closed area and a plurality of spaced supports each having a lower end in engagement with the ground and an upper end connected to and supporting the liner upper rim. The fence system includes at least two spaced apart and elongated struts wherein each strut has a first end and a second end. A hanger is secured to each strut adjacent its first end and this hanger is dimensioned to fit over and be supported by the upper rim of the liner. A fastener assembly secures the second end of the strut to one support while a fence section is secured to the first ends of the struts so that the fence section extends upwardly from the upper rim of the liner.

11 Claims, 3 Drawing Sheets

FENCE SYSTEM FOR AN ABOVE-THE-GROUND SWIMMING POOL

BACKGROUND OF THE INVENTION

I. Field of the Invention

The present invention relates generally to fencing and, more particularly, to a fence system for use with an above-the-ground swimming pool.

II. Description of Related Art

Above-the-ground flexible wall swimming pools have enjoyed increased popularity in recent years. Such above-the-ground swimming pools typically comprise a liner having an upper rim which defines the area of the swimming pool. A plurality of spaced supports extend around the liner and each support includes a lower end which engages the ground while the upper end of each support is connected to and supports the liner upper rim in an elevated position. Access to the swimming pool is provided by a ladder and oftentimes decking is constructed around the upper rim of the swimming pool.

Many municipalities and other governmental bodies have enacted ordinances which require that a fence be provided around the swimming pool for safety reasons. While there have been previously known fencing systems for rigid wall, sheet metal above-the-ground swimming pools, these previously known systems do not work with above-the-ground flexible wall swimming pools.

SUMMARY OF THE PRESENT INVENTION

The present invention provides a fence system for an above-the-ground flexible wall swimming pool which overcomes all of the above-mentioned disadvantages of the previously known devices.

The fence system of the present invention is provided for use in conjunction with an above-the-ground swimming pool of the type having an upper rim which defines a closed area. A plurality of spaced-apart supports extend around the liner. Each support includes a lower end in engagement with the ground while the upper end of each support is connected to and supports the upper rim of the liner in an elevated position.

The fence system of the present invention comprises at least two elongated struts wherein each strut has a first end and a second end. These struts are spaced apart from each other and extend around the swimming pool.

A hanger is secured to each strut adjacent its first end. Furthermore, the hanger is complementary in shape to the shape of the liner upper rim and is dimensioned to fit over and be supported by the upper rim of the liner.

A mounting bracket is secured to each strut adjacent its lower end. A fastener assembly then detachably connects the hanger, and thus the strut, to the support for the swimming pool.

A fence section is then secured to the first or upper ends of the struts so that the fence section extends upwardly from the upper rim of the liner. Preferably, the fence section includes at least two spaced-apart and parallel tubular rails while parallel stiles extend between and secure the rails together. Additionally, each strut includes a tubular portion which extends upwardly from its associated hanger. This tubular portion of the strut is dimensioned to fit into the lower end of the rail thus supporting the fence section to the struts.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
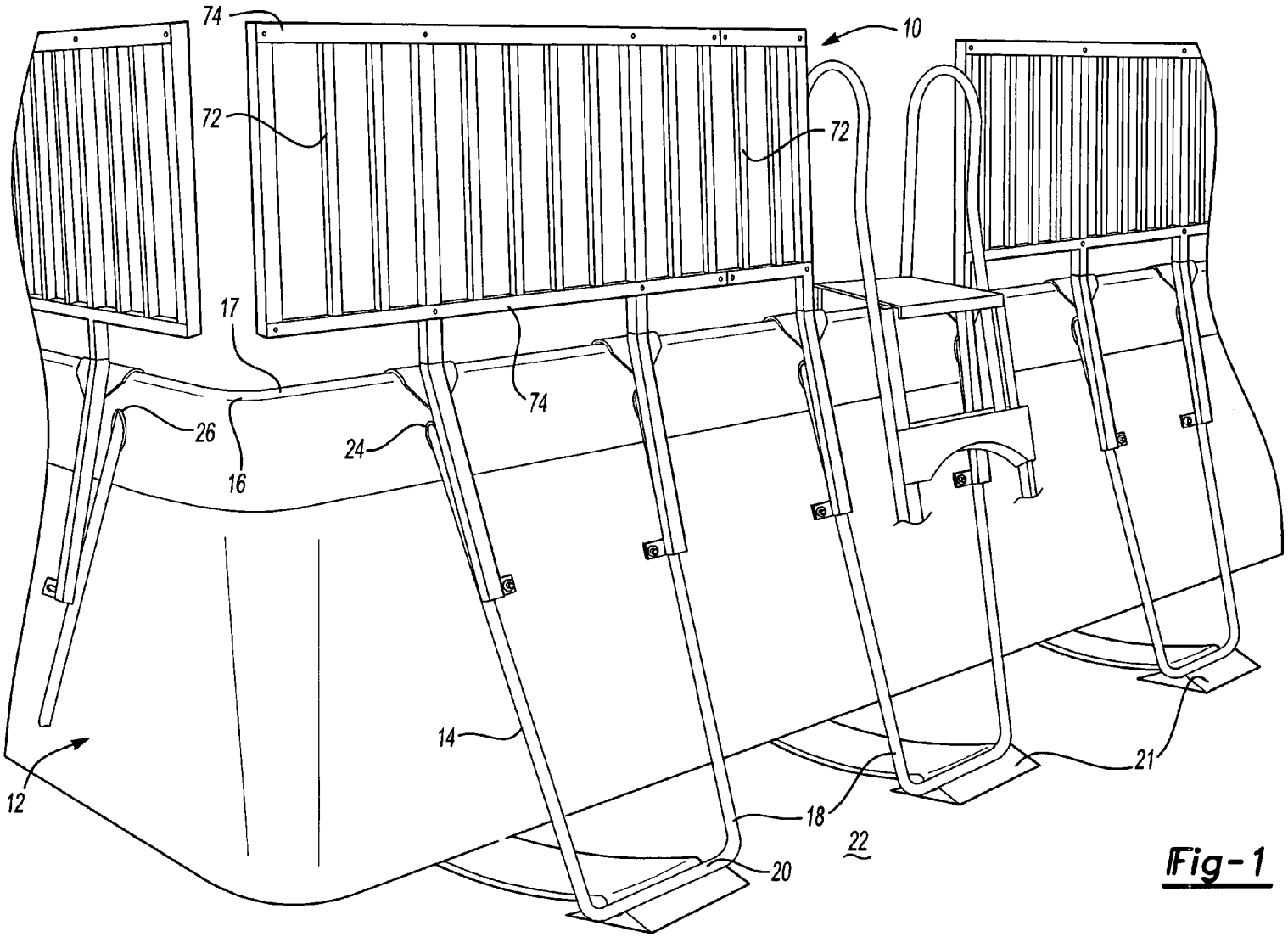
FIG. 1 is a fragmentary elevational view illustrating a preferred embodiment of the present invention.

With reference first to FIG. 1, a preferred embodiment of the fence system 10 is there shown for use with an above-the-ground flexible wall swimming pool 12. In the conventional fashion, the above-the-ground swimming pool 12 includes a liner 14 made of a flexible material and having an upper rim 16 which defines a closed area in the shape of the pool. A rim tube 17 is positioned within the liner 14 and extends around the upper rim 16. The rim tube 17 provides the necessary strength to support the upper rim 16 of the swimming pool 12 in an above-the-ground position.

A plurality of spaced-apart supports 18 are provided at spaced positions around the swimming pool 12. Each support 18 includes a lower end 20 in engagement with a footrest 21 supported on a ground surface 22. An upper end 24 of each support 18 is connected to and supports the rim tube 17. As illustrated in FIG. 1, the support 18 extends through an opening 26 in the liner 12 and is attached to the rim tube 17.

Figure 2:
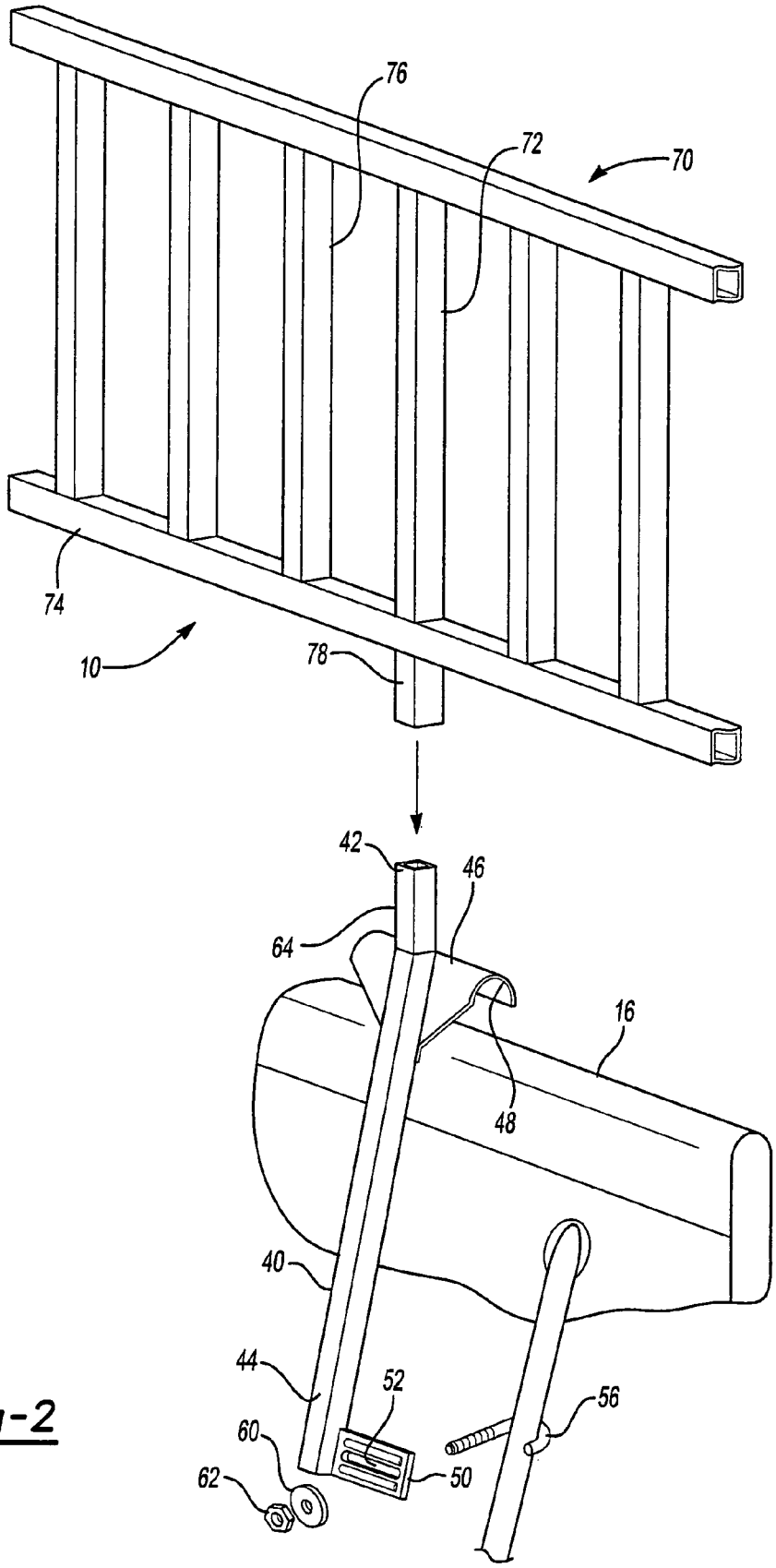
FIG. 2 is a fragmentary exploded view illustrating the preferred embodiment of the present invention.

With reference now to FIGS. 1 and 2, the fence system 10 includes a plurality of spaced-apart elongated struts 40. Each strut 40 includes an upper end 42 and a lower end 44. Preferably, the struts 40 are made of square metal tubing.

A hanger 46 is secured to each strut 40 adjacent its upper end 42. This hanger 46 includes a portion 48 that is complementary to the shape of the upper rim 16 of the swimming pool 12. As shown in the drawing, the rim tube 17, and thus the upper rim 16 of the swimming pool 12, is generally circular in cross-sectional shape so that the hanger portion 48 is semicircular in cross-sectional shape. The hanger 46, furthermore, is secured to the strut 40 in any conventional fashion, such as by welding, brazing, an adhesive, fasteners or the like.

Figure 3:
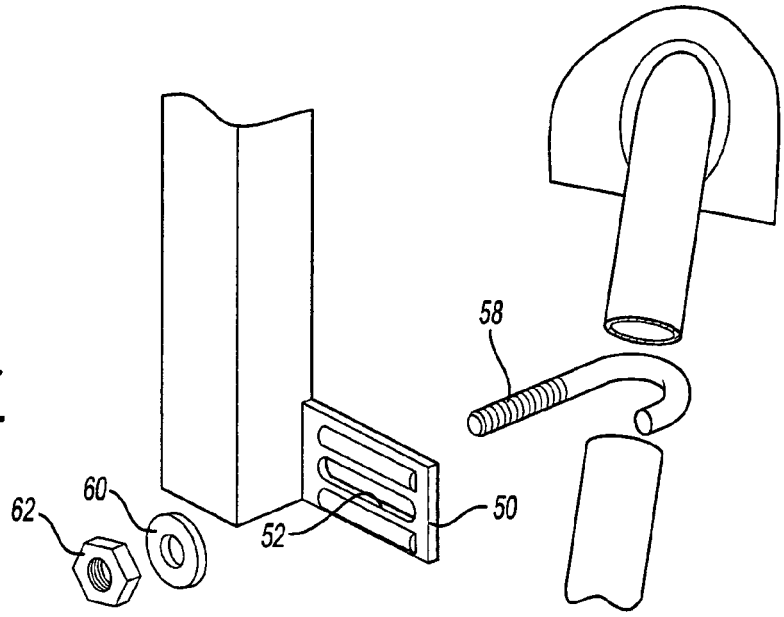
FIG. 3 is a fragmentary elevational view illustrating a portion of the preferred embodiment of the present invention.
Figure 4:
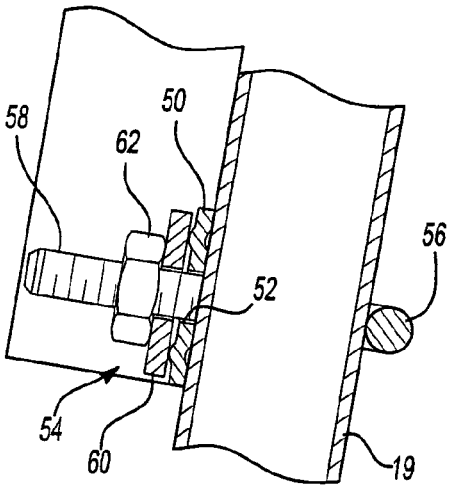
FIG. 4 is a partial longitudinal sectional view illustrating the attachment of the struts to the supports.

With reference now to FIGS. 2–4, a mounting bracket 50 having an opening 52 is secured to each strut 40 adjacent its lower end 44. Preferably, the bracket 50 extends laterally outwardly from the strut 40 such that the brackets 50 associated with each leg 18 face each other.

A fastener assembly 54 detachably secures the mounting bracket, and thus the strut 40, to one leg 19 of the support 18. Preferably, the fastener assembly 54 includes a hook 56 having a threaded shank 58. The hook 56 is dimensioned to fit around and engage the outer periphery of one leg 19 of the support 20. At the same time, the threaded shank 58 of the hook 56 extends through the bracket opening 52 and is secured in position by a washer 60 and nut 62.

Referring now particularly to FIG. 2, each strut 40 includes a tubular portion 64 at its upper end 42. The tubular portion 64 extends upwardly from the hanger 46.

With reference now to FIGS. 1 and 2, the fence system 10 further includes at least one, and more typically several, fence sections 70. Each fence section 70 includes at least two spaced-apart and vertically extending rails 72. Additionally, a pair of spaced-apart and parallel stiles 74 extend between and secure the rails 72 together. A plurality of slats 76 or other obstruction members extend across the area defined between the two spaced-apart rails 72 and the stiles 74 to prevent access through the fence section 70.

Each rail 72 includes a tubular portion 78 which extends downwardly from the lower stile 74. This tubular portion 78, furthermore, is complementary in shape to the tubular portion 64 of the struts 40 and is dimensioned so that the tubular portion 78 of the rail 72 is slidably received over the tubular portion 64 of the strut 40.

Figure 5:
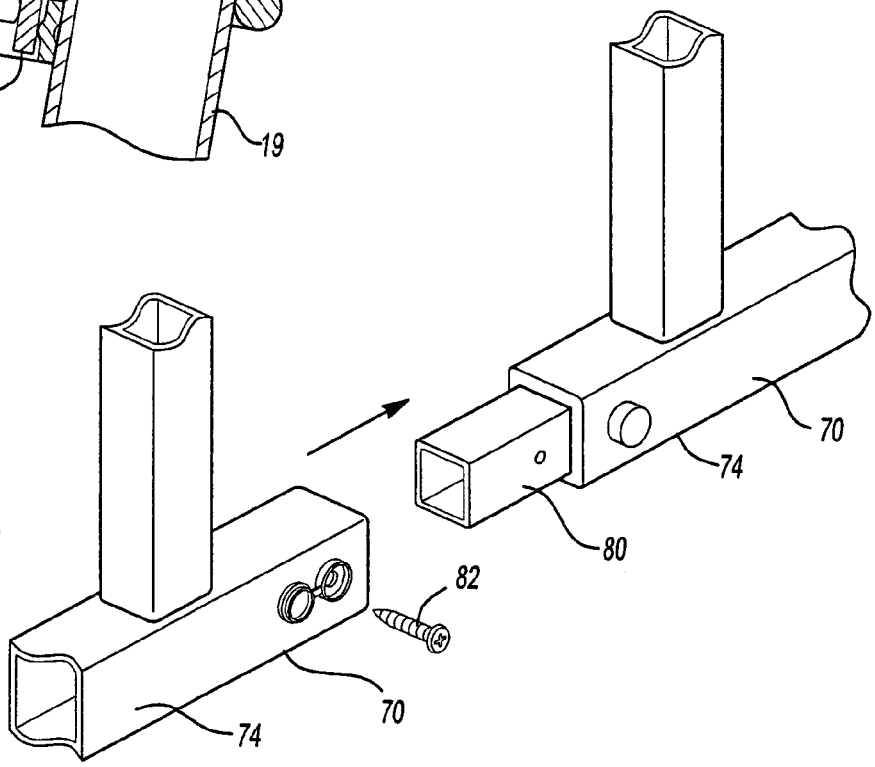
FIG. 5 is a fragmentary exploded view illustrated a portion of the fence section.

With reference now to FIG. 5, in order to secure adjacent fence sections together, and thus reinforce and rigidify the overall fence system, a connector 80 is inserted within the ends of the stiles 74 of adjacent fence sections 70. The connectors 80 are secured to their associated stiles 74 by conventional fasteners 82 thus securing the adjacent fence sections together.

The assembly of the fence system 10 of the present invention to the above-the-ground swimming pool 12 is simple and straightforward. First, the struts 40 are positioned around the swimming pool 12 so that the hanger 46 rests upon the upper rim 16 of the swimming pool 12 and so that the mounting bracket 50 is positioned adjacent one leg 19 of the supports. When thus positioned, the fastener assembly 54 then secures the struts 40 to the legs 19 of the supports 18 so that the tubular portion 64 of each strut 40 extends vertically upwardly from the rim 16. Furthermore, the slot 52 in the mounting bracket 50 provides adjustability to ensure that the tubular portions 64 of the struts 40 are vertically oriented.

After the struts 40 have been secured to the supports 18, the fence sections 70 are then mounted onto the struts 40 by slidably positioning the tubular portion 78 of the rail 72 over the tubular portion 64 of the struts 40. As the fence sections 70 are positioned onto the struts 40, the connectors 80 are installed between the adjacent fence sections in order to rigidify the fence sections 70.

From the foregoing, it can be seen that the present invention provides a simple and yet effective fence system for use with an above-the-ground flexible wall swimming pool that can be rapidly and easily installed. Having described my invention, however, many modifications thereto will become apparent to those skilled in the art to which it pertains without deviation from the spirit of the invention as defined by the scope of the appended claims.

I claim:

1. For use in conjunction with an above-the-ground flexible wall swimming pool having a liner with an upper rim defining a closed area and a plurality of spaced supports each having a lower end supported by a ground surface and an upper end connected to and supporting the liner upper rim, a fence system comprising:

at least two elongated struts, each strut having a first and a second end and said struts being spaced apart from each other, a hanger secured to each strut adjacent said first end, said hanger dimensioned to fit over and be supported by the upper rim, a fastener assembly which secures said second end of said strut to the support, a fence section secured to said first ends of said struts so that said fence section extends upwardly from the upper rim of the liner, wherein said fence section comprises a pair of spaced apart and parallel rails and a pair of spaced apart and parallel stiles extending between and connected to said rails, and wherein each rail includes a tubular lower portion having a predetermined cross sectional shape, and wherein each strut includes an upper tubular portion dimensioned to fit into said rail lower portion.

2. The invention as defined in claim 1 wherein said struts are made of aluminum.

3. The invention as defined in claim 1 wherein said fence section is made of aluminum.

4. The invention as defined in claim 1 and comprising a mounting bracket having an opening and attached to each said strut adjacent said second end, and wherein said fastener assembly comprises a hook dimensioned to engage an outer periphery of the support, said hook having a threaded shank dimensioned to extend through said bracket opening, and a nut which threadably engages said shank.

5. The invention as defined in claim 1 wherein said hanger includes a semicircular portion which engages the liner upper rim.

6. The invention as defined in claim 1 and comprising a connector extending between and secured to the stiles of adjacent fence sections.

7. The invention as defined in claim 6 wherein said connector is mounted within and extends across the junction of two stiles.

8. For use in conjunction with an above-the-ground flexible wall swimming pool having a liner with an upper rim defining a closed area and a plurality of spaced supports each having a lower end supported by a ground surface and an upper end connected to and supporting the liner upper rim, a fence system comprising:

at least two elongated struts, each strut having a first and a second end and said struts being spaced apart from each other, a hanger secured to each strut adjacent said first end, said hanger dimensioned to fit over and be supported by the upper rim, a fastener assembly which secures said second end of said strut to the support, a fence section secured to said first ends of said struts so that said fence section extends upwardly from the upper rim of the liner, and a mounting bracket having an opening and attached to each said strut adjacent said second end, and wherein said fastener assembly comprises a hook dimensioned to engage an outer periphery of the support, said hook having a threaded shank dimensioned to extend through said bracket opening, and a nut which threadably engages said shank.

9. For use in conjunction with an above-the-ground flexible wall swimming pool having a liner with an upper rim defining a closed area and a plurality of spaced supports each having a lower end supported by a ground surface and an upper end connected to and supporting the liner upper rim, a fence system comprising:

at least two elongated struts, each strut having a first and a second end and said struts being spaced apart from each other, a hanger secured to each strut adjacent said first end, said hanger dimensioned to fit over and be supported by the upper rim, a fastener assembly which secures said second end of said strut to the support, a fence section secured to said first ends of said struts so that said fence section extends upwardly from the upper rim of the liner, wherein said hanger includes a semicircular portion which engages the liner upper rim.

10. For use in conjunction with an above-the-ground flexible wall swimming pool having a liner with an upper rim defining a closed area and a plurality of spaced supports each having a lower end supported by a ground surface and an upper end connected to and supporting the liner upper rim, a fence system comprising:

at least two elongated struts, each strut having a first and a second end and said struts being spaced apart from each other, a hanger secured to each strut adjacent said first end, said hanger dimensioned to fit over and be supported by the upper rim, a fastener assembly which secures said second end of said strut to the support, a fence section secured to said first ends of said struts so that said fence section extends upwardly from the upper rim of the liner, wherein said fence section comprises a pair of spaced apart and parallel rails and a pair of spaced apart and parallel stiles extending between and connected to said rails, and a connector extending between and secured to the stiles of adjacent fence sections.

11. The invention as defined in claim 10 wherein said connector is mounted within and extends across the junction of two stiles.

* * * * *